US006750855B1

(12) United States Patent
Von Hase

(10) Patent No.: US 6,750,855 B1
(45) Date of Patent: Jun. 15, 2004

(54) METHOD AND DEVICE FOR COMPENSATING THE PHASE FOR FLAT SCREENS

(75) Inventor: Paul Von Hase, Munich (DE)

(73) Assignee: Fujitsu Siemens computers GmbH, Munich (DE)

( * ) Notice: Subject to any disclaimer, the term of this patent is extended or adjusted under 35 U.S.C. 154(b) by 0 days.

(21) Appl. No.: 09/926,224

(22) PCT Filed: Mar. 17, 2000

(86) PCT No.: PCT/DE00/00835

§ 371 (c)(1),
(2), (4) Date: Oct. 15, 2001

(87) PCT Pub. No.: WO00/58937

PCT Pub. Date: Oct. 5, 2000

(30) Foreign Application Priority Data

Mar. 26, 1999 (DE) ..... 199 13 917

(51) Int. Cl.[7] ..... G09G 5/00
(52) U.S. Cl. ..... 345/204; 348/537
(58) Field of Search ..... 345/3.1, 3.2, 204, 345/211–213; 348/537

(56) References Cited

U.S. PATENT DOCUMENTS 5,767,916 A * 6/1998 West ..... 348/537
5,926,174 A * 7/1999 Shibamiya et al. ..... 345/213
6,097,444 A * 8/2000 Nakano ..... 348/607
6,313,881 B1 11/2001 Reinhart et al.
6,317,005 B1 * 11/2001 Morel et al. ..... 331/20
6,522,365 B1 * 2/2003 Levantovsky et al. ..... 348/537

FOREIGN PATENT DOCUMENTS

| | | |
|---|---|---|
| DE | 39 14 249 | 12/1990 |
| DE | 3914249 A1 | 12/1990 |
| DE | 197 51 719 | 5/1999 |
| EP | 0 805 430 | 11/1997 |
| WO | WO 98/25401 | 6/1998 |

* cited by examiner

*Primary Examiner*—Bipin Shalwala
*Assistant Examiner*—Tom Sheng
(74) *Attorney, Agent, or Firm*—Cohen, Pontani, Lieberman & Pavane

(57) ABSTRACT

The invention relates to a method and a device for matching the phase between the pixel clock of a graphics card and the sampling clock of a flat-panel display with an analog interface in a system comprising flat-panel display, graphics card and computer. Herein the rising edge of a video pulse of a sufficiently bright image spot in the first image column close to the back-porch region is determined. The falling edge of a video pulse at a sufficiently bright image spot in the last image column close to the front-porch region is determined, and the phase is adjusted such that the sampling instant is situated approximately at the midpoint between the rising and falling edges of a video pulse.

17 Claims, 2 Drawing Sheets

Schnelles Videosignal
mit Überschwinger

Träges Videosignal

Ideales Videosignal

Ideales Videosignal

METHOD AND DEVICE FOR COMPENSATING THE PHASE FOR FLAT SCREENS

RELATED APPLICATIONS

This is a U.S. national stage of application No. PCT/DE00/00835, filed on Mar. 17, 2000.

This patent application claims priority of German patent application No.: 199 13 917.2, filed Mar. 26, 1999.

BACKGROUND OF THE INVENTION

1. Field of the Invention

The invention relates to a method and a device for matching the phase between the pixel clock of a graphics card and the sampling clock of a flat-panel display with an analog interface in a system comprising flat-panel display, graphics card and computer.

2. Background Art

Flat-panel displays with an analog interface must be adapted to the graphics card of the connected computer. If phase or sampling frequency is incorrectly adjusted, the image appears fuzzy and contains interferences.

Whereas the values for image location, or in other words right-left and top-bottom adjustment, and for sampling frequency can be defined as preadjusted values in the case of standard modes, this is not possible for the phase, since the phase depends on the graphics card used and also on the video circuit.

Prior art flat-panel displays are usually provided with a microprocessor, which is responsible for general control of the flat-panel display. This microprocessor is configured such that it can also recognize the video mode adjusted on the computer. If the mode has already been adjusted at the factory or by the user, the flat-panel display is operated with the stored adjustments for image location, sampling frequency and phase. On the other hand, if the mode is one which has not yet been implemented in the microprocessor of the flat-panel display, standard values are assumed for image location, sampling frequency and phase. These standard values are not satisfactory in all cases.

The adjustment of the sampling clock and of the phase have a direct effect on image quality. An optimal sampling frequency is achieved when the sampling of all pixels, in one line of a video signal, for example, takes place in a stable or characteristic region of these pixels, such as at the center of each pixel. Data conversion then yields optimal results. The displayed image does not contain any interferences, and is stable. In other words, the optimal sampling frequency is equal to the pixel frequency. If an incorrect sampling frequency has been adjusted, for example if the sampling clock is too fast compared with the pixel clock, the pixels are sampled at first in the permissible region, or in other words at the midpoint between two edges, but the subsequent pixels are sampled progressively more toward one edge, until even the region between two pixels is sampled, which obviously leads to unsatisfactory image quality. Incorrect sampling values are derived from the region in which the pixels are not sampled in an optimal, characteristic region. The image then exhibits strong vertical interference. The number of regions with vertical interference that are visible on the monitor increases as the difference between the frequencies of the sampling clock and the pixel clock becomes larger.

Even in the cases in which the sampling clock is identical to the pixel clock, however, the image quality can suffer if the phase has not been adjusted correctly. The reason is that sampling takes place in a pixel region that is not ideally suitable for sampling, for example too close to the leading or trailing edge of a pixel. This problem can be solved by shifting the phase, or in other words the sampling instant, as the whole until sampling takes place in a characteristic or permissible region of the pixels. If the phase has not been adjusted correctly, the image quality is impaired by noise signals over the entire monitor.

For this reason the users are usually instructed in the manuals and by notices on the packing to perform the necessary adjustment of the phase themselves, but this is unsatisfactory, especially for less experienced users.

Flat-panel displays with analog interfaces, in which phase adjustment is automatically performed, are already known. For such automatic phase-position adjustment, special test patterns with alternating white and black image spots are necessary, and the test pattern must be displayed by the graphics card. This has the disadvantage that software must be installed and started on the computer, and furthermore that this software must be available for all common operating systems.

From German Patent 3914249 A1 there is known a method for recovery from an input signal generated with an unknown clock, wherein the input signal is digitized with a reference clock at different phase positions. The difference between the clock frequency of the input signal and the reference clock is determined from the variation of the phase position (input signal relative to reference clock), and the frequency of the reference clock is corrected accordingly.

A signal-processing method for an analog image signal is described in German Patent 19751719 A1. Therein the analog image signal is obtained from a computing unit, in which the signal has been digitally generated according to a graphics standard such as EGA or VGA and then converted to analog form. The method comprises subjecting the analog image signal to analog-to-digital conversion with a first selected sampling frequency, after which the sampled image is examined for image perturbations, in order to determine a corrected sampling frequency. Further measures relate to determination of the optimal sampling phase and determination of the exact position of the active image relative to the horizontal or vertical synchronization pulses.

BRIEF SUMMARY OF THE INVENTION

In this regard, the object of the invention is to provide a method and a device for matching the phase in flat-panel displays, whereby automatic phase adjustment is possible without the use of test patterns.

To achieve this object, an inventive method is characterized in that the rising edge of a video pulse of a sufficiently bright image spot is determined, in that the falling edge of the video pulse is determined at a sufficiently bright image spot and in that the phase is adjusted such that the sampling instant is situated approximately at the midpoint between the rising and falling edges of a video pulse.

To achieve the said object, an inventive method is further characterized in that the rising edge of a video pulse of a sufficiently bright image spot is determined, and in that the phase is adjusted such that the sampling instant is shifted by approximately half the width of an image spot toward the center of the pixel.

To achieve the said object, an inventive method is further characterized in that the falling edge of the video pulse is determined at a sufficiently bright image spot, and in that the phase is adjusted such that the sampling instant is shifted by approximately approximately half the width of an image spot toward the center of the pixel.

Whereas the image-location and sampling frequencies can be determined and correspondingly adjusted relatively simply by an algorithm, the phase position is more difficult to determine. The three said inventive methods are simple and satisfactory methods for adjusting the phases.

An advantageous embodiment of the inventive method, wherein the image area and image spots are arrayed on the flat-panel display in rows and columns between a back-porch region and a front-porch region, is characterized in that an image spot in the first image column close to the back-porch region is chosen as the sufficiently bright image spot for determination of the rising edge and an image spot in the first image column close to the front-porch region is chosen as the sufficiently bright image spot for determination of the falling edge. The method can be performed particularly well if the most pronounced possible edges are evaluated or if regions or spots disposed next to one another have very different brightness. Thus a spot in the first or last image column is particularly suitable, since it completely satisfies the required conditions in combination with the front-porch or back-porch region respectively, and can be found with relatively little difficulty.

An advantageous embodiment of the inventive method is characterized in that the brightness of a plurality of image spots of the first or last image column is measured, and the image spot with the greatest or adequate brightness in the first or last image column is chosen for determination of the rising or falling edge respectively of the video pulse. In this way it is ensured that image spots with sufficiently pronounced edges are used for the measurement.

An advantageous embodiment of the inventive method is characterized in that the image spots (n×k) are first measured with n=1, 2, . . . N and k=constant, such as 10, and in that, if no adequately bright image spot was found, the image spots (n+m)×k are measured with m=1, 2, . . . N, until a sufficiently bright image spot is found. Thereby a search for suitable image spots is performed efficiently and in the shortest time.

An advantageous embodiment of the inventive method is characterized in that, for determination of the amplitude value of the image spot, the phase is shifted until the measured amplitude values no longer change significantly, and in that the amplitude value then determined is further processed.

Alternatively, an advantageous embodiment of the inventive method is characterized in that the phase used for determination of the amplitude value is advanced sufficiently that the measured amplitude values are smaller than a predetermined limit value, for example smaller than 50% of the amplitude value, in that the phase is delayed by half the width of a spot, and in that the amplitude value then measured is further processed.

The last two of the foregoing embodiments of the inventive method are simple solutions in order to determine the brightness of the image spot as a prerequisite for determination of the position of the rising and falling edge of the image spot.

A further advantageous embodiment of the invention is characterized in that, for determination of the rising edge, the phase is shifted sufficiently toward the back-porch region that the measured amplitude value is reduced to a predetermined percentage, for example 50%, of the previously determined amplitude value, and in that this value of the phase is stored temporarily as the position of the rising edge.

Yet another advantageous embodiment of the invention is characterized in that, for determination of the falling edge, the phase is shifted sufficiently toward the front-porch region that the measured amplitude value is reduced to a predetermined percentage, for example 50%, of the previously determined amplitude value, and in that this value of the phase is stored temporarily as the position of the falling edge. In this way the rising and falling edges of two image spots are determined in simple manner, and the phase can then be adjusted such that it is located between the rising and falling edges at approximately the center of an image spot.

A further advantageous embodiment of the invention is characterized in that the phase or sampling instant is delayed relative to the midpoint between the rising and falling edges by a predetermined amount, for example 10% of the width of the image spot. This is advantageous in particular for rapid video signals with overshoots, since it prevents sampling from taking place in the region of the overshoot.

To achieve the object cited hereinabove, the device for matching the phase between the pixel clock of a graphics card and the sampling clock of a flat-panel display having an analog interface in a system comprising a flat-panel display, graphics card and computer, is characterized by a device that determines the rising edge of a video pulse of a sufficiently bright image spot, a device that determines the falling edge of the video pulse at a sufficiently bright image spot, and an adjusting device with which the phase is adjusted such that the sampling instant is located at approximately the midpoint between the rising and the falling edges of a video pulse.

A further advantageous embodiment of the inventive device is characterized by a device which determines the rising edge of a video pulse of a sufficiently bright image spot, a device that determines the falling edge of the video pulse at a sufficiently bright image spot, and an adjusting device with which the phase is adjusted such that the sampling instant is located at approximately the midpoint between the rising and the falling edges of a video pulse.

Further advantageous embodiments of the inventive method and of the inventive device are evident from the remaining dependent claims.

BRIEF DESCRIPTION OF THE DRAWINGS

Practical examples of the invention will be described hereinafter with reference to the attached drawings, wherein.

DETAILED DESCRIPTION OF THE DRAWINGS

Figure 1:
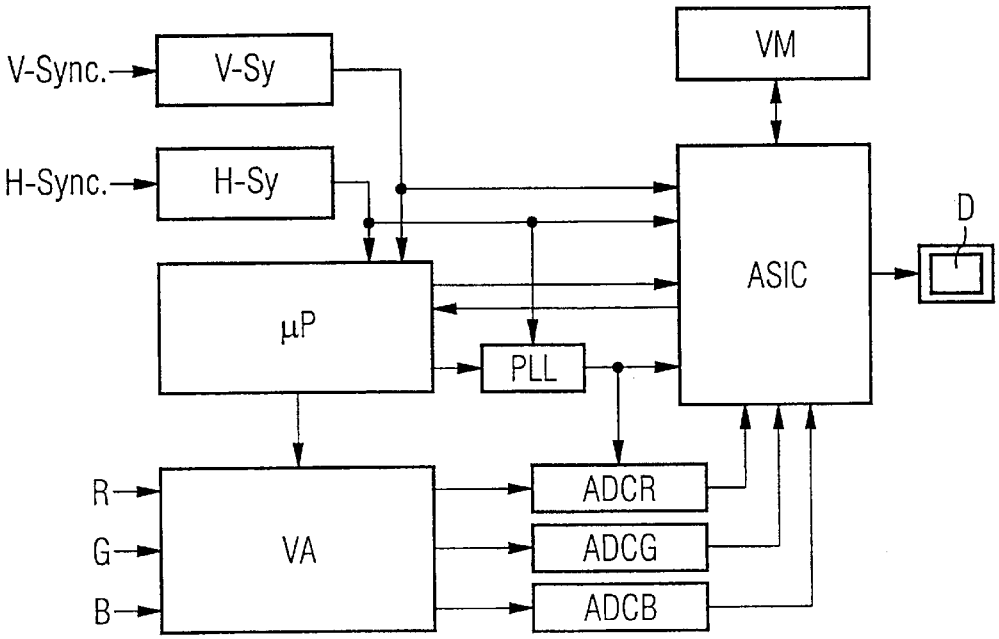
FIG. 1 shows a block diagram of an analog interface to the graphics card of a flat-panel display that can be connected to a computer system.

FIG. 1 shows a control circuit for a flat-panel display, which can be connected via an analog interface, and whose function will be explained in more detail hereinafter with reference to the various input signals and their conditioning. At the input of the control circuit there are applied on the one hand the video signal comprising the three color signals R, G, B, and on the other hand the two synchronization signals H-sync and V-sync for horizontal and vertical image synchronization. H-sync and V-sync are transmitted digitally, with signal voltages of 0 V and >3 V respectively. V-sync signals that the first line of an image is being transmitted. This signal therefore corresponds to the image refresh frequency and is typically in the range between 60 and 85 Hz. H-sync signals that a new image line is being transmitted.

This signal corresponds to the line frequency and is usually around 60 kHz.

The video signal made up of the color signals R, G, B is an analog signal. The signal voltage ranges from 0 V to 0.7 V. The pixel clock, or in other words the frequency with which the value of this voltage can change, is 80 MHz. Since a certain number of image spots is transmitted per image line, the pixel clock frequency is higher than the line frequency (H-sync) by the number of these spots.

The three color signals R, G, of the video signal are fed via a video amplifier VA to analog-to-digital converters ADCR, ADCG and ADCB respectively. The two synchronization signals H-sync and V-sync are conditioned in separate circuits HSy, VSy to the effect that the signal edges eroded by transmission and by various EMC processes are regenerated once again. The synchronization signals H-sync and V-sync conditioned in this way are then fed to a microprocessor $\mu$P. This microprocessor $\mu$P measures their frequency and determines therefrom the resolution adjusted in the graphics card of the computer system. The respective data stored on resolution are then transmitted to a phase-locked loop PLL and, parallel thereto, to a logic circuit designed in the form of an ASIC for conditioning and processing of the digital data.

The phase-locked loop PLL multiplies the frequency of the synchronization signal H-sync with the value transmitted to it by the microprocessor $\mu$P. Hereby the sampling frequency (pixel clock) is obtained. By virtue of a delay time caused in the phase-locked loop PLL, a phase difference is established between pixel clock and sampling frequency. These two parameters can be influenced via the OSD displays on the monitor. The sampling frequency obtained in the phase-locked loop is also fed to the three analog-to-digital converters ADCR, ADCG, ADCB. These convert the analog data stream into a digital data stream. The digitized data are finally further processed in the downstream logic circuit ASIC by means of data contained in a video memory VM. Whereas in the simplest case the data are transmitted in 1:1 correspondence to the flat-panel display that can be connected to the logic circuit ASIC, the video memory VM is often used to achieve time decoupling between the arriving data and the data to be transmitted to flat-panel display D. Data stored in video memory VM are also accessed for interpolation of lower resolutions.

Figure 2:
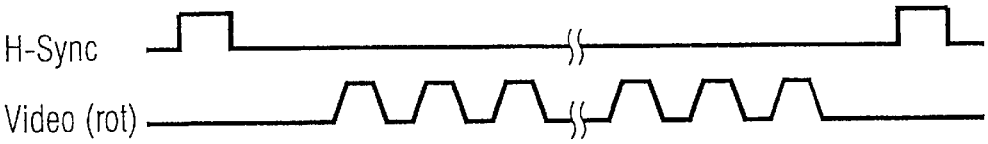
FIG. 2 schematically shows a horizontal synchronization signal and a channel of a video signal, such as the R video signal (R=red color)

FIG. 2 shows the horizontal synchronization signal H-sync and a video signal of one channel, for example of a red color channel R. The video signal is selected in such a way in FIG. 2 that bright and dark image spots are displayed alternately. The broken lines on the video signal show the ideal sampling instant or the ideal phase for digitization of the analog video data. The broken areas on the first two image spots represent the region of the phase which is just still permissible in order that sampling that is still correct can be achieved. After the phase has been matched, it is therefore located on the broken lines. At a resolution of, for example, 1024×768 image spots (XGA) and 75 Hz image refresh frequency, a fuzzy and highly grainy display is already obtained at a phase shift of 4 ns. Thus matching of the phase is critical for good image quality.

Figure 3A:
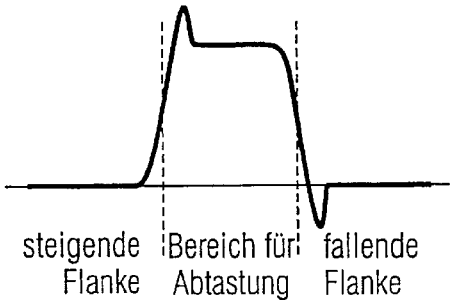
FIGS. 3A and 3B show schematic representations of video signals.
Figure 3B:
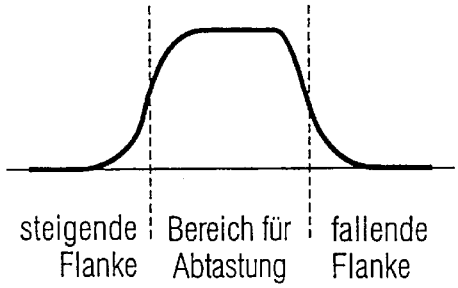

From the representations in FIGS. 3A and 3B it can also be seen that the phase of sampling of the video signal plays a large role for image quality, and that, for different video signals, the phase in many cases must be located at correspondingly different places. Thus FIG. 3A shows a fast video signal with overshoots, wherein the region of sampling between the rising and falling edges of the video signal is relatively narrow and is shifted toward the falling edge. In contrast, FIG. 3B shows a slow video signal without overshoots, wherein the region for sampling between the rising edge and the falling edge is relatively broad and substantially centered. Examination of the two signals shows that they have phase positions, for example on the right side in the region of the falling edge of the slow video signal, in which the measured amplitude values are no longer usable for the slow video signal, whereas amplitude values that are still usable are measured at the same phase position of the fast video signal. On the other hand, it is evident that the ideal phase position is located approximately at the midpoint between the rising and falling edges of the video signal and that it must also be adjusted to this value. Thus it is extremely important to adjust the phase as a function of the respective system.

As already mentioned, automatic phase adjustment is more difficult to achieve than the adjustments of the other parameters. Referring now to the further figures, it will be described how such an automatic adjustment can be undertaken.

Figure 4:
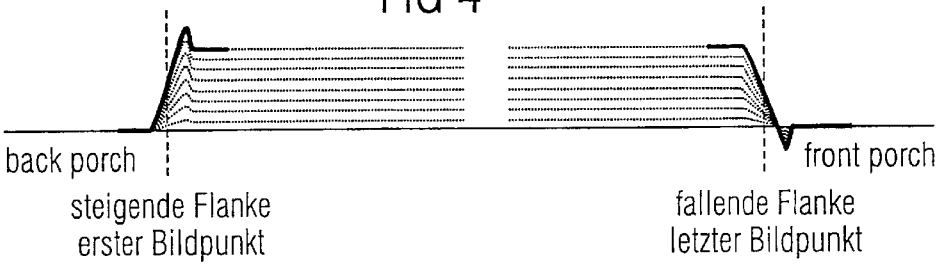
FIG. 4 shows a schematic representation of the rising and falling edges of image spots of a video signal.

As FIG. 4 shows, the starting point for determination of phase position is the edges of the video signals. In order to be able to determine an edge, it is advantageous for this to be as pronounced as possible. This is the case when the signal is as slightly pronounced as possible ahead of the edge and as strongly pronounced as possible after the edge, or vice versa. The first requirement is ideally satisfied by the sampling gap between the back-porch and front-porch regions, and the second is satisfied by a bright image spot. Accordingly, a bright image spot at the beginning of a line is highly suitable for determination of the rising edge and one at the end of a line is highly suitable for determination of the falling edge.

The fact that the edges in question may belong to two different spots, which are possibly located on different image lines, is immaterial, because the pixel clock and sampling clock are known and can be taken into consideration appropriately. The chosen image spots should have sufficiently high intensity in at least one primary color (RGB) that an edge of sufficiently large amplitude is found.

In principle, any combination of one bright and one dark image spot, which can be located at arbitrary places in the video signal, is suitable for determining the edges. In most cases, the sought edges can be determined by the combination of front-porch/back-porch region and one bright image spot in the first/last image column. There is then no need to search through the entire image content for two suitable pairs of spots.

As already illustrated hereinabove, the ideal range for sampling the video signal is that in which specified and actual value of the signal are largely in agreement. Measurement of the amplitude of the video signal in the region of the edge, however, is possible only with difficulty. The reason lies in the jitter of the video signal and of the sampling pulse. If this is coarse compared with the rise or fall time of the video signal, the edges can indeed be found by averaging several measurements, but information on the amplitude of the edge at the measured place cannot be obtained.

Figure 5A:
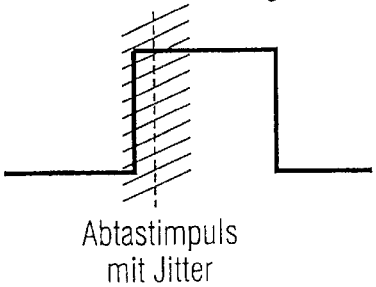
FIGS. 5A and 5B schematically show two ideal video signals and the effect of the position of the sampling pulse in relation to the video signal.
Figure 5B:
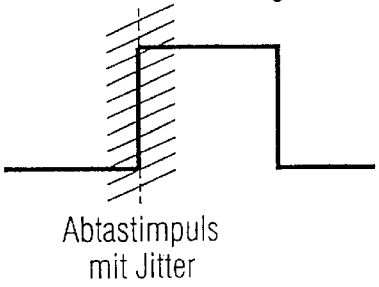

FIGS. 5A and 5B illustrate the problem of detecting the edges. Broken lines representing the desired sampling instant are inserted at the ideal video signals. The hatched area represents the region which, due to the jitter, is actually sampled in the various measurements. If the measured values were to be averaged, an average value of about 80% would be obtained in the first case. This averaged value could be incorrectly interpreted as a location on the rising edge and, in fact, precisely at the place at which this has reached 80% amplitude. This is not the case, however. In the second case, the estimate would be 50%, which already is closer to the true situation.

From these results it is clear that, because of jitter, it will hardly be possible to determine the place on the edge at which this has reached a specified value. Under these circumstances, the least error will usually be made by averaging the measured values at about 50% of the specified value. Obviously other values can also be sought. Smaller values, for example, have the advantage that less accuracy is necessary in determination of the actual amplitude of the image spot.

Hereinafter it will be assumed that the image location and the sampling frequency have already been correctly adjusted. In addition, access to the data of the analog-to-digital converters will be supposed to be possible. The rising edge and the falling edge will be determined as follows, for which purpose the following steps will be performed.

Rising Edge

1. Search for a spot in the first image column which has a sufficiently high, and if at all possible maximal R, G or B value.
2. Since the phase in 1. could have been preadjusted such that the measurement is erroneous, the actual value of the amplitude may be higher. Determine the actual value of the amplitude by a measurement at suitable sampling instant by retarding the phase until the measured amplitude values no longer continue to increase, or by advancing the phase so far at first until the measured amplitude values are very low and this value of the phase, which marks the beginning of the edge, is still retarded by half the pixel width.
3. Shift the phase so far toward the back-porch that the sampling value averaged over several measurements decreases to about 50% of the value determined in 2. Store this value of the phase temporarily, since the rising edge is present here.

Falling Edge

4. Search for one spot in the last image column which has a sufficiently high and if at all possible maximum R, G and B value. In order to obtain the most accurate possible measured values, the phase should be adjusted, before sampling is performed, to the value found in 2.
5. Shift the phase so far toward the front porch that the averaged sampling value decreases to about 50% of the value determined in 4. The falling edge is located at this point.

Alternatively, the sampling instant can also be found by determining the rising edge of a video pulse of a sufficiently bright image spot in the first image column close to the back-porch region, and by adjusting the phase such that the sampling instant is shifted approximately by half the width of an image spot toward the pixel center, or alternatively by determining the falling edge of the video pulse at a sufficiently bright image spot in the last image column close to the back-porch region, and by adjusting the phase such that the sampling instant is shifted by approximately half the width of an image spot toward the pixel center. Steps 1 to 5 described hereinabove are then correspondingly simplified.

The ideal sampling instant is theoretically located exactly between the two edges. In practice, it may be advantageous to sample at a slight delay from the midpoint between two edges rather than exactly at such midpoint, in order to keep away from possible overshoots of the graphics card and to allow for the often slightly exponential character of the edges.

The hardware of the invention comprises a device which determines the rising edge of a video pulse of a sufficiently bright image spot, a device which determines the falling edge of the video pulse at a sufficiently bright image spot, an adjusting device with which the phase is adjusted such that the sampling instant is located approximately at the midpoint between the rising and falling edges of a video pulse, and a device for shifting the phase for determination of the sampling value of the image spot until the measured amplitude values no longer differ significantly, whereupon the sampling value determined then is further processed.

Furthermore, a device is provided which advances the phase used for determination of the sampling value sufficiently that the measured amplitude values are smaller than a predetermined limit value, such as smaller than 50% of the sampling value, and by a device which then retards the phase by half the width of an image spot, whereupon the sampling value measured then is further processed.

Finally, there are provided a device which shifts the phase for determination of the rising edge sufficiently far toward the back-porch region that the measured amplitude value decreases to a predetermined percentage, such as 50% of the previously determined amplitude value, whereupon this value of the phase is stored temporarily as the position of the rising edge, and a device which shifts the phase for determination of the falling edge sufficiently far toward the front-porch region that the measured amplitude value decreases to a predetermined percentage, such as 50% of the previously determined amplitude value, whereupon this value of the phase is stored temporarily as the position of the falling edge.

What is claimed is:

1. A method for matching the phase between the pixel clock of a graphics card and the sampling clock of a flat-panel display with an analog interface in a system comprising flat-panel display, graphics card and computer, characterized in that the rising edge of a video pulse of a sufficiently bright image spot in the first image column close to the back-porch region is determined, in that the falling edge of a video pulse of a sufficiently bright image spot in the last image column close to the front-porch region is determined and in that the phase is adjusted such that the sampling instant is situated approximately at the midpoint between the rising and falling edges of a video pulse.

2. A method for matching the phase between the pixel clock of a graphics card and the sampling clock of a flat-panel display with an analog interface in a system comprising flat-panel display, graphics card and computer, characterized in that the rising edge of a video pulse of a sufficiently bright image spot in the first image column close to the back-porch region is determined, and in that the phase is adjusted such that the sampling instant is shifted by approximately half the width of an image spot toward the center of the pixel.

3. A method for matching the phase between the pixel clock of a graphics card and the sampling clock of a flat-panel display with an analog interface in a system comprising flat-panel display, graphics card and computer, characterized in that the falling edge of a video pulse of a sufficiently bright image spot in the last image column close to the front-porch region is determined, and in that the phase is adjusted such that the sampling instant is shifted by approximately half the width of an image spot toward the center of the pixel.

4. A method according to one of claims 1 to 3, characterized in that the brightness of a plurality of image spots of the first or last image column is measured, and the image spots with the greatest brightness in the first or last image column are chosen for determination of the rising or falling edge respectively of the video pulse.

5. A method according to one of claims 1 to 3, characterized in that the image spots (n×k) are first measured with n=1, 2, . . . N and k=constant, such as 10, and in that, if no adequately bright image spot was found, the image spots (n+m)×k are measured with m=1, 2, . . . N, until a sufficiently bright image spot is found.

6. A method according to one of claims 1 to 3, characterized in that, for determination of the amplitude value of the image spot, the phase is shifted until the measured amplitude values no longer change significantly, and in that the amplitude value then determined is further processed.

7. A method according to one of claims 1 to 3, characterized in that the phase used for determination of the amplitude value is advanced sufficiently that the measured amplitude values are smaller than a predetermined limit value, for example smaller than 50% of the amplitude value, in that the phase is delayed by half the width of a spot, and in that the amplitude value then measured is further processed.

8. A method according to one of claims 1 to 3, characterized in that, for determination of the rising edge, the phase is shifted sufficiently toward the back-porch region that the measured amplitude value is reduced to a predetermined percentage, for example 50%, of the previously determined amplitude value, and in that this value of the phase is stored temporarily as the position of the rising edge.

9. A method according to one of claims 1 to 3, characterized in that, for determination of the falling edge, the phase is shifted sufficiently toward the front-porch region that the measured amplitude value is reduced to a predetermined percentage, for example 50%, of the previously determined amplitude value, and in that this value of the phase is stored temporarily as the position of the falling edge.

10. A method according to one of claims 1 to 3, characterized in that the phase or sampling instant is delayed relative to the midpoint between the rising and falling edges by a predetermined amount, for example 10% of the width of the image spot.

11. A device for matching the phase between the pixel clock of a graphics card and the sampling clock of a flat-panel display with an analog interface in a system comprising flat-panel display, graphics card and computer, characterized by a device which determines the rising edge of a video pulse of a sufficiently bright image spot in the first image column close to the back-porch region, by a device which determines the falling edge of a video pulse of a sufficiently bright image spot in the last image column close to the front-porch region and by an adjusting device with which the phase is adjusted such that the sampling instant is situated approximately at the midpoint between the rising and falling edges of a video pulse.

12. A device for matching the phase between the pixel clock of a graphics card and the sampling clock of a flat-panel display with an analog interface in a system comprising flat-panel display, graphics card and computer, characterized by a device which determines the rising edge of a video pulse of a sufficiently bright image spot in the first image column close to the back-porch region, and by an adjusting device with which the phase is adjusted such that the sampling instant is shifted by approximately half the width of an image spot toward the center of the pixel.

13. A method device for matching the phase between the pixel clock of a graphics card and the sampling clock of a flat-panel display with an analog interface in a system comprising flat-panel display, graphics card and computer, characterized by a device which determines the falling edge of a video pulse at a sufficiently bright image spot in the last image column close to the front-porch region, and by an adjusting device with which the phase is adjusted such that the sampling instant is shifted by approximately half the width of an image spot toward the center of the pixel.

14. A device according to one of claims 11 to 13, characterized by a device for shifting the phase for determination of the instant of sampling of the image spot until the measured amplitude values no longer differ significantly, whereupon the sampling value then determined is further processed.

15. A device according to one of claims 11 to 13, characterized by a device which advances the phase used for determination of the sampling value sufficiently that the measured amplitude values are smaller than a predetermined limit value, such as smaller than 50% of the sampling value, and by a device which then retards the phase by half the width of an image spot, whereupon the sampling value measured then is further processed.

16. A device according to one of claims 11 to 13, characterized by a device which shifts the phase for determination of the rising edge sufficiently far toward the back-porch region that the measured amplitude value decreases to a predetermined percentage, such as 50% of the previously determined amplitude value, whereupon this value of the phase is stored temporarily as the position of the rising edge.

17. A device according to one of claims 11 to 13, characterized by a device which shifts the phase for determination of the falling edge sufficiently far toward the front-porch region that the measured amplitude value decreases to a predetermined percentage, such as 50% of the previously determined amplitude value, whereupon this value of the phase is stored temporarily as the position of the falling edge.

* * * * *